US006449990B1

(12) United States Patent
Kawajiri et al.

(10) Patent No.: US 6,449,990 B1
(45) Date of Patent: Sep. 17, 2002

(54) PURGING APPARATUS FOR REMOVING DIRT FROM WASHING MACHINE

(75) Inventors: Yoshitaka Kawajiri, Hiroshima (JP); Mitsuo Shintaku, Toyota-gun (JP)

(73) Assignees: Hinomaru Carbotechno Co., Ltd, Hiroshima (JP); Pearl Star Co., Ltd., Hiroshima (JP); Wenzhong Ouyang, Tokyo (JP)

( * ) Notice: Subject to any disclaimer, the term of this patent is extended or adjusted under 35 U.S.C. 154(b) by 0 days.

(21) Appl. No.: 09/575,559

(22) Filed: May 21, 2000

(30) Foreign Application Priority Data

Jun. 21, 1999 (JP) ..... 11-174379

(51) Int. Cl.[7] ..... D06F 29/00
(52) U.S. Cl. ..... 68/235; 68/17 R; 68/207
(58) Field of Search ..... 68/17 R, 207, 68/235; 8/159; 134/114; 210/680, 242.2, 242.3, 282, 484, 502.1

(56) References Cited

U.S. PATENT DOCUMENTS 2,268,182 A * 12/1941 Bowers
3,617,566 A * 11/1971 Oshima et al.
3,819,390 A * 6/1974 Teng et al.
3,960,722 A * 6/1976 Tomikawa et al.
3,976,570 A * 8/1976 McCray
4,172,039 A * 10/1979 Akiyama
4,197,204 A * 4/1980 Mathes
4,312,907 A * 1/1982 Hiraoka et al.
4,401,475 A * 8/1983 Eriksson et al.
4,416,782 A * 11/1983 Kerres
4,591,441 A * 5/1986 Sakai
4,838,947 A * 6/1989 Levy et al.
4,840,734 A * 6/1989 Johnson
5,245,722 A * 9/1993 Dameron
5,407,575 A * 4/1995 Vinsonhaler
5,423,985 A * 6/1995 Addeo et al.
5,475,992 A * 12/1995 Weigert
5,511,265 A * 4/1996 Caputo
5,718,015 A * 2/1998 Rohrbacher
5,978,994 A * 11/1999 Anderson
6,143,170 A * 11/2000 Briggs et al.
6,152,025 A * 11/2000 Oien et al.
6,264,398 B1 * 7/2001 Yamada et al.

FOREIGN PATENT DOCUMENTS

DE 88 16 896.4 G 4/1991
EP 0 870 862 A2 10/1998
JP 54-30659 * 3/1979
JP 59-131699 * 7/1984

* cited by examiner

*Primary Examiner*—Frankie L. Stinson

(57) ABSTRACT

A dirt and oil removing apparatus that is placed in the tub of a household or industrial washer for reducing or eliminating the need for detergent. The dirt and oil removing apparatus includes a water permeable receptacle made of a lipophilic fiber, which absorbs oil or oil like liquids. The receptacle holds pieces of inorganic material for absorbing or adsorbing dirt and pieces of lightweight material for decreasing the density of the apparatus as a whole. Preferably, the density of the apparatus as a whole is about 0.90 to about 0.93.

16 Claims, 1 Drawing Sheet

PURGING APPARATUS FOR REMOVING DIRT FROM WASHING MACHINE

BACKGROUND OF THE INVENTION

A. Technical Field

The present invention relates to an apparatus for removing dirt from the water of a washing machine and, more particularly, to an apparatus for purging water by removing dirt from the water when washing clothes or similar articles in a household or industrial washer.

B. Background Art

When clothes are washed in a washer, dirt from the clothes being washed is removed by a purging function or action. A conventional powder or gel or liquid detergent has such a purging function. Specifically, the purging function of a detergent is where molecules of the detergent surround a dirt particle to make the dirt particle "dissolve" in the water of the washer. A detergent or soap molecule may have a hydrophilic end (or polar ionic region) and a hydrophobic end (or nonpolar hydrocarbon region). Hydrophobic ends of many soap molecules cluster around each other and the hydrophilic ends face the water molecules where they are solvated by the water. Such a structure is called a micelle. A dirt particle, typically of organic material, is trapped or "dissolved" in the hydrocarbon interior of the micelle such that the dirt particle is "dissolved" in the water of the washer. The formation of micelles aids in removing or "dissolving" dirt directly from the clothes and in "dissolving" dirt in the water of the washer.

The dirt removed from the washed products flows with the water in the washer and is pumped from the washer at some time in the cycle, such as during the rinse cycle. This dirt that is removed includes dirt that is solvated by the detergent via micelles and dirt that has not been "captured" by a micelle.

SUMMARY OF THE INVENTION

A. Object of the Invention

Extremely dirty loads or even normal dirty loads are problematic for washers. For example, dirt that is first removed from the clothes at the beginning of the washing cycle may reattach itself to the clothes at a later point in the cycle. Further, the cleaning function of the cleaner decreases when too much dirt enters into the water in the washing cycle; in other words, there is relatively too much dirt and too little cleaner or detergent available to form an effective number or micelles to solvate the dirt particles.

When the clothes (or other products or articles) have too much dirt, the amount of detergent (i.e., soap or cleaner) may be increased. However, even when the amount of detergent is increased, the clothes at the end of the cycle may not be sufficiently clean. Further, this solution wastes detergent and may produce an excessive amount of waste water.

Another solution is the use of Binchou charcoal as a substitute for or in combination with detergent.

When Binchou charcoal is placed in water, dirt such as fine dirt or dirt particles is adsorbed onto the surface of the charcoal or is absorbed into the charcoal such that dirt is purged or removed from the water. When Binchou charcoal is placed into the water of a washer, the dirt in the water is removed such as by adsorption or absorption. Binchou charcoal may work side by side with detergent or may work alone without detergent.

Binchou charcoal is one kind of many charcoals that may be employed to work in a washer. These charcoals, including Binchou charcoal, undergo a special sintering process. This sintering process heats without melting the charcoal to "weld" powdered charcoal into a homogeneous mass so that powder does not come loose from the charcoal to color or blacken the clothes or water.

Charcoal such as Binchou charcoal may be produced in the form of a bar or in a powdered or pulverized form. When in the shape of a bar, the charcoal has little surface area for taking in dirt particles by either adsorption or absorption and hence such form does not produce a sufficient purging function. The powdered or pulverized (and sintered) charcoal has a greater surface area for a greater purging function, but it is difficult to separate the powdered or pulverized charcoal. from the washed clothes during the rinse cycle or during drying or after the clothes have been dried. Further, if the powdered or pulverized charcoal is used in combination with detergent, the detergent treats the charcoal particles as dirt particles such that the detergent action is wasted on the charcoal that competes with the dirt for the detergent.

In addition, since charcoal such as Binchou charcoal has a relatively great density and a density that is greater than water, it sinks to the bottom of the washer and out of the way of the dirt being removed from the clothes in the washer. Dirt, often in the form of fine particles in the washer, tends to float to the surface of the water in the washer.

Thus, objects of the present invention are to effectively utilize characteristics of inorganic materials that have purging functions such as adsorption or absorption of charcoal such as Binchou charcoal, to make the cleaning process inside of a washer more efficient, to decrease the amount of detergent used in a washer, and to decrease the amount of waste water to thereby decrease environmental pollution such as pollution of the rivers and waterways where detergents, even after treatment by municipalities, may cause harm.

B. Disclosure of the Invention

The present purging apparatus for removing dirt from a washing machine is placed directly into the water of a household or industrial washer and includes the following features. The purging apparatus includes a bag holding pieces of inorganic material. The bag is preferably made of a lipophilic fiber and is permeable to water. The pieces of inorganic material have a dirt purging function; such as a dirt adsorption or dirt absorption function. The bag further holds pieces of a lightweight material for adjusting the density of the bag when the bag is holding both the pieces of inorganic material and the pieces of lightweight material. (The pieces of lightweight material may be referred to herein as relative density adjusting pieces.) The pieces of inorganic material and lightweight material are mixed thoroughly with each other in the bag so as to produce a uniform dispersion of the pieces with each other in the bag. The amount and weight of the pieces of inorganic material may be relatively great or relatively small and the amount and weight of the pieces of lightweight material may be relatively great or relatively small. Preferably, the mass of the pieces of inorganic material and the mass of the pieces of lightweight material are selected such that the density of the purging apparatus (i.e. the bag, the pieces of inorganic material, and/or the pieces of lightweight material) is about 0.90 to about 0.93. It should be noted that the bag may be formed from a relatively lightweight material such that, in some cases, no pieces of lightweight material need be used to reach a preferred density such as the preferred range of about 0.90 to about 0.93.

DETAILED DESCRIPTION OF THE INVENTION

Figure 1:
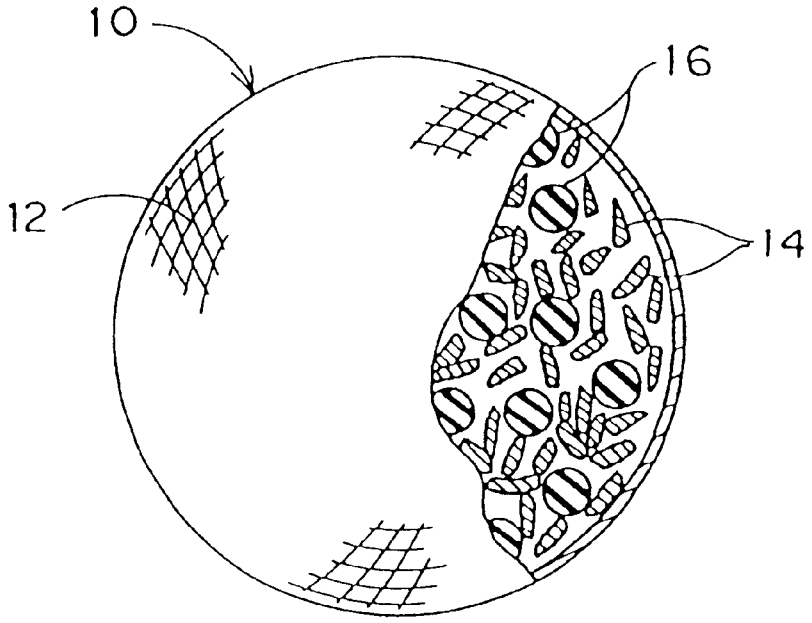
FIG. 1 is a front view, partially in section, of one embodiment of a purging apparatus according to the present invention.

A. Bag for Holding Pieces of Inorganic Material and Pieces of Lightweight Material The material for the bag is made up of a nonwoven fabric or a knit fabric. The fiber making up the nonwoven fabric or the fiber making up the knit fabric is preferably a lipophilic fiber. A fiber having no lipophilicity may be mixed into or woven with the lipophilic fiber as long as the nonlipophilic fiber does not detract from the manufacturing process for the lipophilic fiber, does not detract from the manufacturing process for the material for the bag, does not detract from the manufacturing process for the bag, itself and does not detract from the function of the lipophilic fiber or bag itself.

The bag has the following basis features. The bag holds the requisite amount of pieces of inorganic material or the bag holds the requisite amount of pieces of inorganic material and the requisite amount of pieces of lightweight material. The bag holds the requisite amount of pieces (i.e. both pieces of inorganic material and pieces of lightweight material) without permitting the pieces to fall out of the bag when the bag is oriented in any direction, such as right side up or upside down. The bag is permeable to water or, more specifically, the material making up the bag is permeable to water, so that water such as dirty water in the washer can pass into the bag to make contact with the pieces of inorganic material. In other words, openings in the material making up the bag are sufficiently large to permit dirty water to pass through at a relatively great rate and are sufficiently small to keep the pieces of inorganic material and the pieces of lightweight material in the bag. Preferably, the openings in the material making up the bag are sized so as to maximize the rate at which water can pass through without permitting the pieces of inorganic material and pieces of lightweight material to fall through such openings and, at the same time, the size of the pieces of inorganic material are minimized to maximize the amount of surface area available for the adsorption or absorption of dirt.

Preferably, the bag for holding the pieces of inorganic material and lightweight material have smooth and/or continuous outer faces, have no corners or sharp corners on the outer faces and are symmetrical. These shapes and similar shapes move freely and easily with flowing water like water being agitated in a washer. Further, these shapes rotate freely and easily when in the water of a washer. Still further, these shapes have outer surfaces where, when a force such a flowing water or the paddle of an agitator hits the outer surface, the bag moves in an arbitrary direction. More preferably, the bag is formed in a round or spherical like shape because 1) such a bag moves easily and freely, 2) such a bag rotates easily and freely, and 3) when a force such as flowing water or the paddle of a washer agitator hits anywhere on the outer surface of such a bag, the resultant direction of the bag is arbitrary.

If desired, the bag can be formed in the shape of a cube or a cubic like shape. These forms can be produces by sewing at least two pieces of fabric material together. Instead of a sewing or stitching process, the two pieces of. fabric material may be heat melted together or fixed together with adhesive.

It should be noted that a bag of one shape may be heated with or without pressure to make a bag of another shape. Or, if desired, pressure with or without heat may be brought to bear on a bag of one shape to make a bag of another shape.

It should be noted that material for making up the bag may be heated with or without pressure to change the shape of the material so as to form a bag of a certain shape. It should further be noted that material for making up the bag may be subjected to pressure with or without heat to change the shape of the bag.

Charcoal (and other inorganic material that have adsorb and/or absorb dirt) is relatively dense. It is therefore advantageous to make the bag as light as possible so as to decrease the density of the bag so as to minimize the amount of requisite pieces of lightweight material so as to make room for and maximize the amount of pieces of inorganic material such as charcoal. One way to make a lipophilic fiber as light as possible is to introduce air into the fiber itself so as to expand the fiber so that a given mass of fiber takes up a greater amount of space. One way to expand a fiber or introduce air between fibers is to subject the fiber to a silicon processing method where the fiber takes on the lipophilic quality of water rejection (the quality of being hydrophobic). By making the bag relatively light, the amount of pieces of lightweight material is minimized or the need for lightweight material is eliminated. By making the present purging apparatus (i.e. the bag and the pieces of inorganic material or the bag and pieces of inorganic material and pieces of lightweight material) relatively light or to a density of the preferred range, the bag can flow with water more easily and more freely.

B. The Pieces of Inorganic Material

Relatively little pieces of various inorganic material having the absorption and/or adsorption functions can be used as long as such functions to absorb and/or adsorb the dirt conventionally found in the water of a household or industrial washer. Preferred inorganic material is charcoal, ore, and stone. Preferred charcoal is bamboo charcoal or Binchou charcoal. More preferred charcoal is Binchou charcoal. Further, Binchou charcoal is preferably charcoal sintered at the relatively high temperature of 1200 degrees C., and is very hard, and has a porous internal structure, and absorbs/adsorbs efficiently a variety of substances. Preferred ore is tourmaline ore (electric ore). Preferred tourmaline ore is that which interacts ionically with water or applies an electrical or static charge to water so as to more effectively remove dirt from the charged water. Preferred stone is Bakuhanseki that is a Japanese name and belongs to quartz porphyry, rhyolite or oolite in mineralogy.

It is preferable to increase the surface area of the pieces of inorganic material. This is done by reducing the size of the pieces, and relatively small pieces of inorganic material are preferable. These pieces that are relatively small and that have a relatively great amount of surface area have a purging or cleaning capability that is relatively great. At the same time, the pieces of inorganic material are sufficiently large or the openings in the fabric making up the bag are sufficiently small so that the pieces of inorganic material stay in the bag and are not caught in the openings of the bag and do not pass through the openings in the bag. Still further, other features to take into account are how much the pieces of inorganic material will abrade or destroy the inside of the bag. Preferably, the sizes of the pieces of inorganic material fall in the range from about one millimeter to about three millimeters where such a measurement is made along the longest length of the piece, which may often be of an irregular shape.

The shapes of the pieces of inorganic material are usually different because of the nature of charcoal and because of the production process of, for example, Binchou charcoal. The pieces of inorganic material may be formed in a round or spherical like shape, in a rod or column or tubular shape. The pieces of inorganic material may have scales. The pieces of inorganic material may be irregular.

Binchou charcoal and ore may be used in combination with each other. Further, such a combination is preferable to using just Binchou charcoal alone or using just ore alone. For a given amount of a combination of Binchou charcoal and ore (e.g. 150 grams), such a combination performs better than when the given amount of Binchou charcoal (e.g. 150 grams) is used alone or when the given amount of ore (e.g. 150 grams) is used alone. It is preferable to include Binchou charcoal and ore in such a combination where Binchou charcoal falls in the range of about 75 to about 95 parts by weight and ore falls in the range of about 25 to about 5 parts by weight (i.e., in parts by weight in the bag, the ratio of Binchou charcoal to ore equals about 75 (Binchou charcoal) to about 25 (ore) to about 95 (Binchou charcoal) to about 5 (ore)). Where too much Binchou charcoal is present, the water in the washer may take on a little color. Where too much ore is present, the water in the washer becomes hard, which reduces the capability of the cleaner to form micelles and clean.

C. The Pieces of Lightweight Material to Adjust the Density of the Purging Apparatus as a Whole The density of the pieces of inorganic material is usually much greater than the density of water. Therefore, the pieces of inorganic material tend to sink in water. By including pieces of lightweight material in the bag with the pieces of inorganic material, the density of the purging apparatus as a whole is decreased and the purging apparatus and its pieces of inorganic material flow easily in the vicinity of the surface of the water in the washer. Further, the density of the bag itself is taken into account when selecting the pieces of inorganic material and the pieces of lightweight material.

As to the pieces of lightweight material, various inorganic or organic materials can be used as long as they do not detract from the capability of the pieces of inorganic material to remove dirt and as long as they are compatible with the clothes being washed. Preferably, the pieces of lightweight material are formed from a soft material that would not damage the clothes or other articles being washed. More preferably, the pieces of lightweight material are formed from natural rubber, synthetic rubber, and soft synthetic resin and similar materials. The density of the pieces of lightweight material are preferably less than about 1.0 and more preferably about 0.9 to about 0.91.

Further as to the pieces of lightweight material, it should be noted that synthetic rubber or soft synthetic resin that adsorbs or absorbs dirt particles is preferred. Porous synthetic rubber or porous soft synthetic rubber are examples of a lightweight material that adsorbs or absorbs dirt particles and aids the pieces of inorganic material in purging dirty water of the washer.

The dimensions and shapes of the pieces of lightweight material are chosen so that the pieces of lightweight material can be mixed uniformly with the pieces of inorganic material. For example, the shape of the pieces of lightweight material may be spherical, may have multiple faces like a pyramid (that has four faces), may have multiple faces like a cubic dice used in gambling (that .has six faces), may have even more multiple faces, may be formed in the shape of a disk, and may have an irregular shape. Preferably, the length of the pieces of lightweight material, when measured along its longest length, is about five millimeters to about ten millimeters.

D. Purging Apparatus

The purging apparatus includes the bag, the pieces of inorganic material and the pieces of lightweight material. Another embodiment of the purging apparatus includes the bag and the pieces of inorganic material. The purging apparatus is made by filling the bag with a predetermined amount of the pieces of inorganic material and, if desired, the pieces of lightweight material. The bag is then closed or sealed to prevent the pieces of inorganic material and pieces of lightweight material from falling out of the bag such as when the bag is turned on its side or turned upside down.

The ratio of the pieces of inorganic material to the pieces of lightweight material varies according to the density of the purging apparatus as a whole. Preferably, the ratio by weight of the pieces of inorganic material: to the pieces of lightweight material is 100:50~100:10. More preferably, such a ration is 100:30~100:20. In other words, the pieces of inorganic material are preferably included in the bag at about 100 parts by weight and the pieces of lightweight material. are included in the bag in the preferred range of about 10 to about 50 parts by weight. More preferably, the pieces of inorganic material are included in the bag at about 100 parts by weight and the pieces of lightweight material are included in the bag in the range of about 20 to about 30 parts by weight.

The bag may be sealingly closeable and reopenable or the bag may be permanently scaled. Preferably the bag is sealingly closeable so as to permit pieces of inorganic material or pieces of lightweight material to be taken out of the bag so as to adjust the density of the purging apparatus as a whole.

The density of the purging apparatus as a whole is preferably about 0.9 to about 0.93. The weight of the purging apparatus is preferably distributed equally such that the center of gravity is centrally located in the purging apparatus so as to maximize the capability of the purging apparatus to spin in all directions so as to maximize contact of the surfaces of the bag with the dirty water and so as to maximize contact of all pieces of inorganic material with dirty water flowing into the bag.

The size of the purging apparatus is selected based upon the volume of the water to be pumped into the washer. Preferably, the size of the purging apparatus, when measured along its longest length, is from about eight millimeters to about ten millimeters.

The purging apparatus may be used in the household washer or the industrial sized washer. Whether in the household washer or industry washers, the purging apparatus flows during the washing cycle in the vicinity of the surface of the water in the washer.

One or two or more purging apparatus may be used in a washer at the same time. Two or more purging apparatus may be used to increase the amount of dirt particles removed. It should be noted that it is preferable to use more relatively small purging apparatus for a given amount of pieces of inorganic material than to use less relatively large purging apparatus having the given amount of pieces of inorganic material.

The purging apparatus of the present invention may be used with or without detergent. When the purging apparatus is used with detergent, less detergent may be used (than when the detergent is used by itself). For example, if the amount of the detergent is decreased to about one-fifth of that which is normally used, the end result (the cleaniness of the clothes and the solvating of the dirt particles in the wash water), is about the same as when 5/5 parts (one part) of the detergent is used (i.e. when the detergent is used by itself). Therefore, one may rely less on the powerful synthetic detergents that are more difficult for the municipalities to break down and that are more apt to cause pollution and rely more on the less powerful but more environmentally friendly natural soaps. These natural soaps are usually powdered soaps that includes salt. Salt is preferred in natural soaps 1) because salt, especially natural salt, includes a high mineral content, 2) because salt is a bleaching agent, and 3) because salt is a disinfectant. Vinegar is another preferred ingredient to be added to the water of a washer because vinegar makes clothes soft.

E. Fffects and Advantages of the Invention

The present purging apparatus for the household or industrial washer removes dirt from water in the washer as articles are being washed. It removes the dirt efficiently. It removes the dirt without the aid of detergents. It removes dirt with the aid of detergents. It removes dirt even if the bag is not formed of a lipophilic material. It removes even more dirt when the bag is formed of a lipophilic material. Further, the bag alone removes dirt from the water of the washing machine when the bag is formed of a lipophilic. Still further, when a lipophilic bag is used in combination with the pieces of inorganic material, more dirt is removed than the total amount of dirt that is used when the lipophilic bag is used alone without the pieces of lipophilic material and when the pieces of inorganic material are used in a bag formed of nonlipophilic material. Accordingly, the amount of detergent can be decreased or detergent can be eliminated altogether for at least some kinds of articles to be washed, the cost or washing is decreased, and pollution is reduced.

DETAILED DESCRIPTION OF THE PREFERRED EMBODIMENTS

As shown in FIG. 1, a purging apparatus is spherical and includes a bag 12, pieces 14 of inorganic material, and pieces 16 of lightweight material. Pieces 16 may also be referred to a density adjusting pieces.

The fabric of the bag 12 is Pyren. Pyren is a product name, and Pyren fabric is made by Mitsubishi Reiyon Sya. Pyren is a polypropylene lipophilic fiber and has a density of 0.91. The fiber is soft to the touch. The fiber can be made into a relatively long fiber and still have sufficient mechanical strength and sufficient resistance to breakage.

The pieces 14 of inorganic material are finely pulverized pieces of Binchou charcoal (density of 1.8). The Binchou charcoal pieces 14 have irregular shapes and are about four millimeter to about ten millimeters along their longest length dimension.

The pieces 16 of lightweight material are made of natural rubber and have a density of 0.91. The pieces 16 have irregular shapes and are about five millimeters to about ten millimeters in diameter (as measured by the two diametrically opposite surface portions on the piece 16 that are the greatest distance apart).

Bag 12 includes 130 grams of pieces 14 of inorganic material and 20 grams of pieces 16 of lightweight material. The bag 12 itself weighs 15 grams.

The purging apparatus 12 is a sphere having a radius of about five centimeters. The total weight of the purging apparatus 12 is 165 grams and its density is about 0.91. It should be noted that, since there is air space inside the bag 12, the density as calculated separately from the different parts of the purging apparatus 12 (i.e. the bag 12, the pieces 14 and the pieces 16) is different from the density calculated when the pieces 14 and 16 are in the bag 12.

Figure 2:
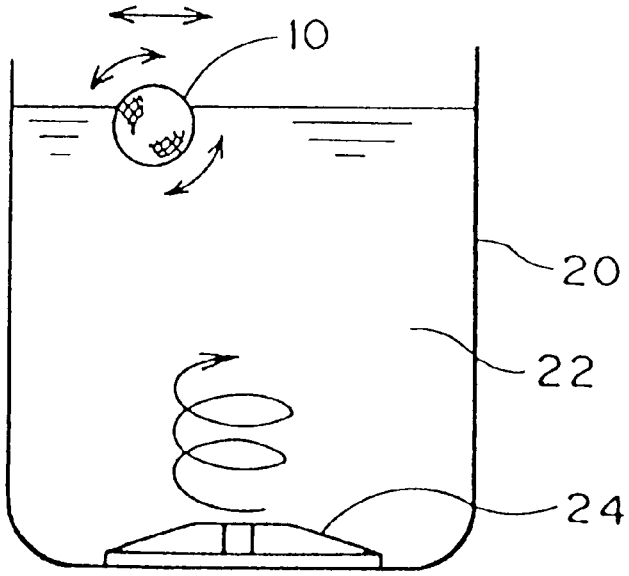
FIG. 2 shows the purging apparatus of FIG. 1 in operation.

FIG. 2 shows the purging apparatus of FIG. 1 in operation in a washer.

Among other features, a washer includes a tub 20 and a stirrer or agitator or stirring wing 24 disposed at a lower level in the tub 20. The purging apparatus is placed into the tub 20 either prior to, during, or after water has been pumped into the tub 20. Detergent is usually placed in the tub prior to water is pumped into the tub 20. The purging apparatus has a density which is close to, if not almost exactly the same as, the density of the water 22 and therefore floats or flows or spins near the surface of the water 22 in the tub 20.

The agitator 24 agitates the water 22 which in turn agitates the clothes. Also, the agitator 24 may directly agitate the clothes. When the clothes are agitated, dirt is loosened from the clothes and is picked up by the water 22. The dirt, often being fine particles of dirt or fine beads of oil or oil like liquid, floats to the surface or flows in the vicinity of the surface as the water 22 is agitated. This may being the fine particles of dirt and fine beads of oil or oil like liquid components into contact with the purging apparatus 10. The beads of oil or beads of oil like liquid components may be absorbed by the lipophilic fiber of the bag 12. The fine dirt particles may flow through the bag 12 and into the bag 12 and about the pieces 14 of inorganic material and pieces 16 or lightweight material, and these fine particles of dirt may be adsorbed or absorbed by the pieces 14 of inorganic material and pieces 16 of lightweight material (if the pieces 16 of lightweight material have a purging function). When the pieces 14 of inorganic material are formed of Binchou charcoal, fine dirt particles are especially efficiently adsorbed and/or absorbed.

The purging apparatus 10 generally moves in a horizontal direction because it tends to float at or near the surface of the water 22. As it moves or flows in such a horizontal direction, the purging apparatus 10 is subject to random forces caused by the agitated water 22. These forces are relatively great and occur at a relatively high frequency so as to toss and turn the purging apparatus 10 about in the water. The purging apparatus 10 rotates in the water and is pushed to arbitrary positions in the water because the purging apparatus 10 is spherical and because its center of gravity is near its geometric center. It should be noted that, while a washer usually agitates water in the washing machine with great force at frequent intervals, washers also quite often are used for delicate articles of clothing like sweaters, where a gentle washing is desired and where the speed or rate of the agitator is intentionally decreased. In such a case where a gentle washing is desired, the purging apparatus 10 works well because, as it is spherical and its center of gravity is its geometric center, it will still rotate and still be tossed and turned easily. Even where a cubic bag is used, such a cubic bag will be exercised (i.e. will rotate and be tossed and turned) by relatively small forces where the center of gravity of the cubic bag is its geometric center.

The purging apparatus 10 works much like a toothed circular saw blade cutting into a plank of wood. As the circular saw blade is rotated, one tooth bites into the plank. This first tooth then disappears into the plank. Then, as the tool is slid in the horizontal direction across the plank of wood, the second tooth bites into a new portion of the plank of wood. This second tooth then disappears into the plank of wood to permit still a third tooth to bite into another portion of the plank. Likewise, portions of the purging apparatus 10 bite into water, especially into the surface of the water where fine particles of dirt and fine beads of oil or oil like liquid tend to collect. That is, the spherical lipophilic material of the bag 12 rolls across the surface of the water and step by incremental step absorbs (or adsorbs) the small beads of oil or oil like liquid. The pieces 14 of inorganic material roll with the bag 12 and step by incremental step absorbs (or adsorbs) the fine particles of dirt. As the lipophilic material and pieces 14 of inorganic material roll, the portions that have just picked up the oil or dirt rotate away (either above or below and rarely on a vertical axis) from the surface of the water where the portions have just picked up the oil or dirt. This rotation away from the pick up place brings new portions of the lipophilic material or pieces 14 of inorganic material into play. These new portions, though they have already picked up oil or dirt, have "regenerated" themselves in that these new portions have had time to draw the oil or dirt into their interiors in an attempt to reach equilibrium.

Further, as portions that have just picked up dirt rotate away and "fresh" portions of the pieces 14 rotate into the surface of the water to pick up dirt, it should be noted that the pieces 14 of inorganic material are constantly being mixed and shifted around. This mixing and shifting around cycles "fresh" pieces 14 and less "fresh" pieces 14 about in the bag 12. Further, this mixing and shifting around rotates each of the pieces 14 by itself in the bag 12 so as to reorientate fresh and used surface portions of the pieces 14 themselves.

As a result, all surfaces or faces of the bag 12 are used for the operation of the purging function and all surfaces of all of the pieces 14 of inorganic material are used for the operation of the purging function. It should be noted that the pieces 16 of lightweight material, when having a purging function, enjoy the same action as the pieces 14 of inorganic material so that all of the surfaces of all of the pieces 16 of lightweight material are used for the operation of the purging function.

After the washing operation, the purging apparatus 10 is taken out of the tub 20, washed with water, and dried. Preferably the purging apparatus 10 is dried under sunlight and at standard atmospheric conditions. The purging apparatus can be used repeatedly. Over a relatively long period of time, its purging function may decrease whereupon the old pieces 14 can be exchanged for new pieces 14 and/or the old bag 12 can be exchanged for a new bag 12.

It should be noted that when the density of the purging apparatus 10 is too great, the purging apparatus sinks to the bottom of the tub 20 or settles to a level close to the bottom of the tub 20. At these locations, the purging apparatus 10 cannot make contact with the dirt that collects near the surface of the water 22 in the tub 20 and the purging function of the apparatus 10 would therefore be inferior. Such a heavy purging apparatus 20 may be formed when the only the pieces 14 of inorganic material are included in the bag 20. On the other hand, when the bag 12 having pieces 14 of inorganic material is fixed on the surface of the water 22 in the tub 20 to float at only one position, dirt is removed from the water only inmmediately after the start of the washing cycle because there is no movement, or relatively little movement, of the bag 12 or the pieces 14 of inorganic material therein. Since the purging apparatus 10 floats on the water surface at the same location, the portions of the lipophilic bag 12 and pieces 14 of inorganic material making contact with the water become saturated with dirt and the capability of such saturated portions to absorb or adsorb more oil or dirt falls rapidly.

EXAMPLES

Excellent purging functions for the purging apparatus 10 can be provided by following the examples shown in Table 1. The examples show different ratios for the, pieces 14 of inorganic material and pieces 16 of lightweight material.

TABLE 1

| | Bag | Pieces of inorganic material | Pieces of lightweight material |
|---|---|---|---|
| Example 1 | Polypropylene 15 g | Binchou charcoal 130 g | Natural rubber 20 g |
| Example 2 | Polyvinyl chloride 20 g | Binchou charcoal 130 g | Natural rubber 50 g |
| Example 3 | Polypropylene 15 g (silicon processing) | Binchou charcoal 130 g | Natural rubber 17 g |
| Example 4 | Polyvinyl chloride 20 g (silicon processing) | Binchou charcoal 130 g | Natural rubber 25 g |
| Example 5 | Polypropylene 15 g | Binchou charcoal 80 g tourmaline ore 20 g | Natural rubber 30 g |
| Example 6 | Polypropylene 15 g | Binchou charcoal 90 g tourmaline ore 10 g | Natural rubber 30 g |

In the Table shown above, the bag 12, or the material for the bag 12, is made hydrophilic by silicon processing. With silicon processing, the material for the bag 12 can be made to be floatable on water. The amount of pieces 16 of lightweight material can therefore be reduced or eliminated. Silicon processing is especially effective for polyvinyl chloride, whose density prior to silicon processing is about 1.37. Please see example 4.

In examples 5 and 6, the pieces 14 of inorganic material include both pieces of Binchou charcoal and ore. The size of the pieces of ore ranged from about 1.4 millimeters to about four millimeters. Clothes, after being washed with such a combination, were soft. This may be at least partially attributed to the ionic charge of the ore. The water 22 in the tub 20 during or after washing was not colored by the Binchou charcoal.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. An apparatus for removing dirt from water in a washing machine, comprising:

a water permeable receptacle comprising a lipophilic fiber;

pieces of inorganic material in the receptacle, with the pieces of inorganic material having the capability to remove dirt from water;

pieces of lightweight material in the receptacle, with the pieces of lightweight material being mixed in with the pieces of inorganic material; and wherein the density of the receptacle, pieces of lightweight material and pieces of inorganic material is about at or slightly less than the density of water such that the apparatus floats at or near the surface of a body of water.

2. The apparatus of claim 1 wherein the lipophilic fiber comprises a polypropylene.

3. The apparatus of claim 1 wherein the lipophilic fiber comprises a polyvinyl chloride.

4. The apparatus of claim 1 wherein the inorganic material comprises Binchou charcoal.

5. The apparatus of claim 1 wherein the inorganic material comprises bamboo charcoal.

6. The apparatus of claim 1 wherein the inorganic material comprises tourmalinie ore.

7. The apparatus of claim 1 wherein the inorganic material comprises Bakuhanseki.

8. The apparatus of claim 1 wherein the inorganic material comprises Binclou charcoal and tourmaline ore, wherein the ratio of Binchou charcoal to tourmaline ore being about 75:25 to about 95:5.

9. The apparatus of claim 1 wherein the lightweight material comprises natural rubber.

10. The apparatus of claim 1 wherein the lightweight material comprises synthetic rubber.

11. The apparatus of claim 1 wherein the lightweight material comprises a synthetic resin.

12. The apparatus of claim 1 wherein the receptacle is spherical.

13. The apparatus of claim 1 wherein the receptacle is elliptical in section.

14. The apparatus of claim 1 wherein the receptacle is tubular.

15. An apparatus for removing dirt from water in a washing machine, comprising:

a water permeable fabric bag comprising a lipophilic fiber;

pieces of inorganic material in the fabric bag, with the pieces of inorganic material having the capability to remove dirt from water;

pieces of lightweight material in the fabric bag, with the pieces of lightweight material being mixed in with the pieces of inorganic material; and wherein the density of the fabric bag, pieces of lightweight material and pieces of inorganic material is about at or slightly less than the density of water such that the apparatus floats at or near the surface of a body of water.

16. The apparatus of claim 15 wherein the lipophilic fiber is selected from the group consisting of polypropylene fibers and polyvinyl chloride fibers, wherein the inorganic material is selected from the group consisting of Binchou charcoal inorganic material, bamboo charcoal inorganic material, tourmaline ore inorganic material, and Bakuhanseki inorganic material, and wherein the lightweight material is selected from the group consisting of natural rubber lightweight material, synthetic rubber lightweight material and synthetic resin lightweight material.

* * * * *